United States Patent [19]

Fantuzzo et al.

[11] Patent Number: 4,563,078

[45] Date of Patent: Jan. 7, 1986

[54] ELECTROSTATOGRAPHIC APPARATUS FRAME WITH PLURAL ALTERNATIVE MOUNTING ELEMENTS

[75] Inventors: Joseph Fantuzzo, Webster; Edwin R. Monkelbaan, Fairport; Henry R. Till, Rochester, all of N.Y.

[73] Assignee: Xerox Corporation, Stamford, Conn.

[21] Appl. No.: 645,962

[22] Filed: Aug. 31, 1984

[51] Int. Cl.[4] ..... G03G 15/00

[52] U.S. Cl. ..... 355/3 R; 355/8; 355/3 FU; 355/3 DD

[58] Field of Search ..... 355/3 R, 3 DR, 3 BE, 355/16, 3 FU, 3 DD

[56] References Cited

U.S. PATENT DOCUMENTS

| | | | |
|---|---|---|---|
| 3,301,126 | 1/1967 | Osborne et al. | 88/24 |
| 3,604,797 | 9/1971 | Szczesniak | 355/16 |
| 4,236,807 | 12/1980 | Kuehnle | 355/3 R |
| 4,270,856 | 6/1981 | Goida | 355/3 R |
| 4,286,861 | 9/1981 | Matsumoto et al. | 355/3 R |
| 4,335,950 | 6/1982 | Gunzelmann et al. | 355/3 R |
| 4,372,669 | 2/1983 | Fantuzzo et al. | 355/3 R |
| 4,376,579 | 3/1983 | Wakao | 355/3 DR |
| 4,462,677 | 7/1984 | Onoda | 355/3 R |

*Primary Examiner*—A. C. Prescott

[57] ABSTRACT

Automatic reproducing apparatus frame assembly for mounting individual reproducing apparatus components thereto including a lower frame member having a plurality of mounting elements attached thereto for mounting at least one reproducing apparatus component thereto, the mounting elements being spaced from each other and arranged in parallel fashion in one direction from one side of the frame member to the opposite side of the frame member whereby components may be mounted to the frame member at one of the alternate mounting elements of the plurality of mounting elements to provide the assembly of automatic reproducing machines having one of a plurality of process widths corresponding to the distance from one side of the frame member to one of the alternate mounting elements. Preferably the lower frame member is a plastic molded frame and the plurality of mounting elements are integrally molded therein. The apparatus may include a rear mounting frame comprising a boot-like cover slidably engageable with the lower frame member, thereby providing a variable dimension frame assembly with common frames front and rear and the capability of using common drive modules and platen drive modules for copiers having different process widths.

12 Claims, 6 Drawing Figures

ELECTROSTATOGRAPHIC APPARATUS FRAME WITH PLURAL ALTERNATIVE MOUNTING ELEMENTS

BACKGROUND OF THE INVENTION

The present invention relates to an automatic reproducing apparatus and particular to the frame assembly used in such apparatus. In particular, the present invention relates to a frame assembly including a lower frame member having a plurality of mounting elements attached thereto which are arranged in parallel fashion from the front of the machine to the back of the machine to enable the mounting of individual reproducing apparatus components thereto to provide the assembly of reproducing machines having one of a plurality of process widths.

Historically in the manufacture of automatic reproducing machines, the construction initially was based on a main frame comprising one or more large die castings of aluminum or the like to which operational subassemblies such as developer housing, cleaner housing or copy sheet transport would be mounted. Often times the subassemblies themselves were built on a small die cast frame members to which each of individual subassembly parts had to be fixed. Some machines, in large part, consisted of massive frames and subframe structures to which the individual operational elements were directly mounted or mounted through brackets. Typical of commercial products of this nature were the Xerox 914 and 3600 model copiers. The Xerox 3600 model is exemplified in U.S. Pat. No. 3,301,126 to Osborne et al.

The next step in the development of the frame structure was the use of sheet metal as the principle frame structure. Although some die castings were still used for mounting subassemblies, a rapid switch to the use of sheet metal and steel bracketing replaced the high level use of metal die castings. However the individual operational parts of the machine continued to be assembled first as a subassembly which was mounted to the main frame. Exemplary of this type of copier construction is the Xerox 4000 copier.

A later development in automatic reproducing machine construction was the use of a unitized type of construction which uses a sheet metal frame with as many of the individual operational elements being mounted directly to it. In this type of construction, the use of subassemblies is to a very large degree replaced by mounting the individual elements directly to the sheet metal frame. This type of construction is exemplified by that found in the Xerox 3300 copier. A variant of this type of construction uses straight pieces of sheet metal with punched and machined holes for mounting supporting brackets and machine elements.

In all these techniques, a very large number of suitable brackets, holders or subassembly frames are required to hold or mount every single piece of the entire operational structure of the machine onto the frame assembly. The number of parts including mounting blocks, brackets and fasteners is very large. In addition, it is necessary to drill or tap several suitable mounting holes in the frame and subframe structures. Further and perhaps most important from an operational sense, every mounted element or assembly must be adjusted for operational tolerances relative to its frame structure as well as relative to the other operational elements or assemblies with which it interacts. For example, the developer assembly, charging corotron assembly and cleaning assembly must all be aligned and adjusted for operational tolerances with the photoconductor drum. It also frequently happens that these adjustments become loose with time and use and must be continuously aligned for maximum operational efficiency and copying quality. In addition the assembly costs to put all these parts together and adjust them increases to a very high degree as the number of parts and complexity of adjustment increases. Simply said, it cost more to install every single screw in a machine.

PRIOR ART

An alternative frame assembly as well as one in which some of the difficulties discussed above are minimized is that which is described in U.S. Pat. No. 4,335,950 to Gunzelmann et al. wherein the plastic frame assembly has integrally molded machine elements provided therein. In particular, the frame assembly includes upper and lower molded plastic frame members each having sheet guiding elements integrally molded therein such than when a copy sheet is being processed through the reproducing apparatus, it is guided along its path by the top and bottom sheet guiding elements. This frame assembly reduces the number of parts necessary to be assembled as well as the assembly time and overall cost to manufacture and increases the machine reliability of the paper handling system.

In the automatic reproducing apparatus industry there is a continuing need and desire to both reduce the design, development and manufacturing costs of the individual copiers as well as provide a variety of copiers with a variety of reproduction capabilities (different size originals or different size copies). This is particularly prevalent in the small copier industry wherein copiers are frequently designed for individual customer uses. For example, some customers require only the capability of reproducing ordinary letter size $8\frac{1}{2}\times 11$ inch sheets, whereas other individual uses include the capability of being able to copy a variety of sizes including sheets up to, for example, the International A3 size which is about 11.69 inches by 16.54 inches. The customer requiring capability of producing only U.S. letter size paper originals only requires a machine with that capability. Machines which are capable of reproducing originals of larger than letter size are traditionally larger in size as well as more costly. In addition as the capabilities of the copiers increase, additional features are typically added at an additional cost. Accordingly, in order for a reproducing apparatus manufacturer to be able to supply the needs of all its customers, a family of copiers having different copying capability is required. In the past this family of copiers has been produced by the individual design, development and manufacture of specific copiers for each particular market segment or reproduction capability. The costs associated with the individual design, development and manufacture for each of such a family of unique copiers is naturally very high and there is a great desire to reduce such costs. Furthermore there is a great desire for small copier manufacturers to make as great a percentage of the machine parts for different copiers as common as possible. It is also a desire particularly in the price sensitive lower end of the automatic reproducing apparatus market to provide the customer with the lowest possible cost products.

SUMMARY OF THE INVENTION

In accordance with the present invention, an automatic reproducing apparatus including a frame assembly having a plurality of mounting elements for mounting thereto reproducing apparatus components at different positions to provide the assembly of automatic reproducing machines having one of a plurality of process widths is provided. With this frame assembly a plurality of automatic reproducing machines having different capabilities in producing copies therefrom of a variety of width is provided. Furthermore, a high degree of common machine parts including lower frame, front and side covers and rear cover as well as certain reproducing apparatus components such as a machine drive module and platen assembly can be provided. With this frame assembly a family of products having different process dimensions may be obtained at substantially reduced design development and manufacturing costs.

A specific aspect of the present invention includes an automatic reproducing apparatus comprising a frame assembly for mounting thereto individual reproducing apparatus components, the frame assembly including a lower frame member of molded plastic material having a plurality of mounting elements integrally molded therein for mounting at least one reproducing apparatus component thereto, the mounting elements being spaced from each other and arranged in parallel fashion in one direction from one side of the frame member to the opposite side of the frame member whereby components may be mounted to the lower frame member at one of the different alternate mounting elements of the plurality of mounting elements to provide the assembly of automatic reproducing machines having one of a plurality of process widths corresponding to the distance from the one made of the frame member to one of the alternative mounting materials.

In a further aspect of the present invention, each of said plurality of mounting elements is the same differing from each other only in the distance it is spaced from the one side of the frame member.

In a further aspect of the present invention, the plurality of mounting elements are spaced from the one side of the frame member a distance to provide a process width corresponding to a standard commercial paper size.

In a further aspect of the present invention, one side of the frame member corresponds to the front of the reproducing apparatus and the mounting elements are spaced therefrom toward the rear of the apparatus.

In a further aspect of the present invention, the lower frame member includes integrally molded front and side covers for said reproducing apparatus.

In a further aspect of the present invention, the mounting elements are mounting elements for reproducing apparatus drive module and platen drive module.

In a further aspect of the present invention a rear frame member is provided comprising a boot-like cover and means to fasten said rear cover to the lower frame member at alternate different positions corresponding to one of said plurality of alternate mounting elements to provide an apparatus of the process width corresponding to said one of said plurality of mounting elements.

In a further aspect of the present invention the frame member includes means to mount at least one reproducing apparatus component thereto and the drive module includes means to mount the other end of the component thereto.

In a further aspect of the present invention, the apparatus includes means to mount a developer housing, a platen drive assembly module and a fuser assembly.

Accordingly it is an object of the present invention to provide an automatic reproducing apparatus frame assembly which can be used for manufacture of a plurality of machines having different process widths.

It is a further object of the present invention to provide an automatic reproducing apparatus frame assembly for a family of products having different copying capabilities at substantially the same cost to develop and design and manufacture a single product.

DESCRIPTION OF THE PREFERRED EMBODIMENT

Figure 1:
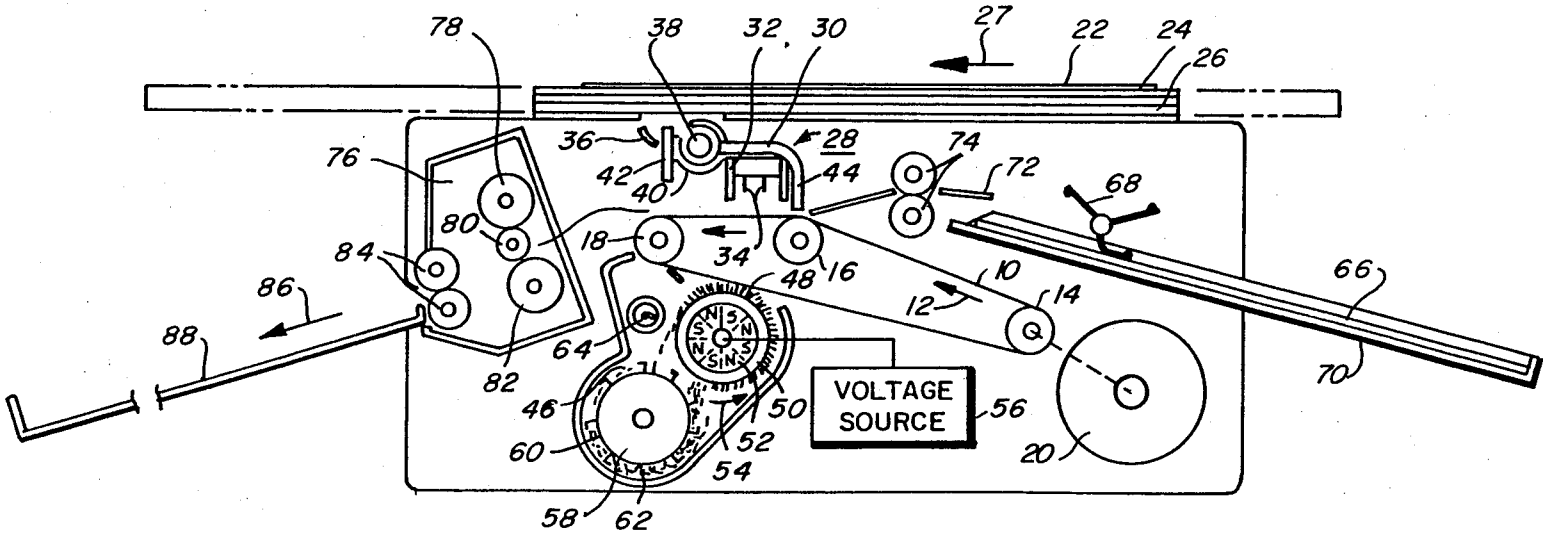
FIG. 1 is a schematic representation in cross section of an automatic electrostatographic reproducing apparatus wherein the frame assembly of the present invention may be utilized.

The invention will now be described with reference to a preferred embodiment of the frame assembly for an electrostatographic reproducing apparatus according to the present invention.

The drawings schematically depict the various components of an electrostatic reproducing machine incorporting the features of the present invention therein. In the drawings and specification, like numerals have been used throughout to designate identical elements. It will become evident from the following discussion that these features are equally suited for use in a wide variety of electrostatic reproducing machines and are not necessarily limited in their application to the particular embodiments depicted therein.

FIG. 1 is representative of the type of electrostatographic reproducing apparatus that may be employed in the practice of the present invention. As now shown in the drawing, the electrophotographic reproducing machine employs a belt 10 having a photoconductive surface deposited on a conductive substrate. Preferably, the photoconductive surface is made from an organic photoconductor with the conductive substrate being made from an aluminum alloy. Belt 10 moves in the direction of arrow 12 to advance successive portions of the photoconductive surface through the various processing stations disposed about the path of movement thereof. Rollers 14, 16 and 18 maintain belt 10 under suitable tension. Roller 14 is coupled to drive motor 20. Rollers 16 and 18 are mounted in suitable bearings to rotate freely and act as idler rollers. Motor 20 drives roller 14 to advance belt 10 in the direction of arrow 12.

An original document 22 is disposed facedown upon a transparent platen 24. Platen 24 is mounted in a frame 26 which is capable of reciprocating motion in a horizontal direction, as indicated by arrow 27. Belt 10 is driven at a linear velocity substantially equal to the linear velocity of platen 24. Belt 10 moves in a recirculating path. In order to reproduce a copy of an original document, belt 10 performs two complete cycles of movement through the recirculating path.

During the first cycle, belt 10 advances a portion of the photoconductive surface initially beneath a charging-transferring unit, indicated generally by the reference numeral 28. Charging-transferring unit 28 includes a corona generating device 30 which charges the photoconductive surface of belt 10 to a relatively high substantially uniform potential. Corona generating device 30 includes a U-shaped shield 32 having an open end opposed from the photoconductive surface of belt 10. Two rows of substantially equally spaced pins 34 extend outwardly from shield 32 toward the open end thereof opposed from the photoconductive surface of belt 10.

Next, belt 10 advances the charged portion of photoconductive belt 10 beneath a combined exposing-discharging unit, indicated generally by the reference numeral 36. Combined exposing-discharging unit 36 includes a light source 38, preferably an elongated tungsten lamp. Light source 38 is disposed stationarily beneath platen 24. An opaque shield 40 surrounds light source 38. Shield 40 has a slit therein so that the light rays from light source 38 are projected onto original document 22 disposed facedown on transparent platen 24. As platen 24 moves in the direction of arrow 27, successive incremental portions of original document 22 are illuminated. Light rays reflected from original document 22 are transmitted through a bundle of image transmitting fibers, indicated generally by the reference numeral 42. Image transmitting fibers 42 are bundled gradient index optical fibers, such as those described in U.S. Pat. No. 3,658,407 issued to Kitano et al. in 1972. The light rays reflected from the original document are transmitted through the image transmitting fibers onto the charged portions of the photoconductive surface of belt 10 to selectively dissipate the charge thereon. This records an electrostatic latent image on the photoconductive surface of belt 10 which corresponds to the informational areas contained within original document 22. Combined exposing-discharging unit 36 also includes a light transmitting glass fiber optical tube 44. One end of optical tube 44 is disposed closely adjacent to light source 38 the other end of optical tube 44 is positioned closely adjacent to the photoconductive surface of belt 10 prior to combined charging-transferring unit 28 in the direction of movement of belt 10, as indicated by arrow 12.

Thereafter, belt 10 advances the electrostatic latent image recorded on the photoconductive surface to a combined developing-cleaning unit, indicated generally by the reference numeral 46. Combined developing-cleaning unit 46 includes a developer roller, indicated generally by the reference numeral 48. Developer roller 48 comprises an elongated cylindrical magnet 52 mounted interiorally of tubular member 50. Tubular member 50 rotates in the direction of arrow 54. Voltage source 56 is electrically connected to tubular member 50 so as to electrically bias tubular member 50 to a potential ranging from about 50 volts to about 500 volts. A specific selected voltage level depends upon the potential level of the latent image and that of the background areas. During development, the biasing voltage is intermediate that of the background and latent image. Conveyor 58 which comprises a cylindrical member 60 having a plurality of buckets 62 thereon advances developer material comprising magnetic carrier granules having toner particles adhering triboelectrically thereto upwardly to developer roller 48. Developer roller 48 attracts the developer material thereto. As tubular member 50 rotates in the direction of arrow 54 the developer material is transported into contact with the latent image and toner particles are attracted from the carrier granules thereto. In this way, a toner powder image is formed on the photoconductive surface of belt 10. Auger 64 mixes the toner particles with the carrier granules. Preferably, tubular member 50 is made from a non-magnetic material such as aluminum having the exterior circumferential surface thereof roughened. Magnetic member 52 is made preferably from barrium ferrite having a plurality of magnetic poles impressed thereon. A metering blade, not shown, may be employed to define a gap between tubular member 50 through which the developer material passes. This gap regulates the quantity of developer material being transported into contact with the electrostatic latent image recorded on the photoconductive surface of belt 10.

After the toner powder image is formed on the photoconductive surface of belt 10, belt 10 returns the toner powder image to the combined charging-transferring unit 28 for the start of the second cycle. At this time, a copy sheet 66 is advanced by sheet feeder 68 to combined charging-transferring unit 28. The copy sheet is advanced in a timed sequence so as to be in synchronism with the toner powder image formed on the photoconductive surface of belt 10. In this way, one side of the copy sheet contacts the toner powder image at combined charging-transferring unit 28. Preferably, sheet feeder 68 includes a rotatably mounted cylinder having a plurality of spaced, flexible vanes extending outwardly therefrom. The free end of each vane successively engages the uppermost sheet 66 of stack 70. As feeder 68 rotates, sheet 66 moves into chute 72. Registration roller 74 advances sheet 66, in synchronism with the toner powder image on the photoconductive surface of belt 10, to the combined charging-transferring unit 28.

Corona generating device 30 of combined charging-transferring unit 28 sprays ions onto the backside of the copy sheet. This attracts the toner powder image from the photoconductive surface belt 10 to the sheet. After transfer, the sheet continues to move with belt 10 until the beam strength thereof causes it to strip therefrom as belt 10 passes around roller 18. As the sheet separates from belt 10, it advances to a fuser assembly, indicated generally by the reference numeral 76. Preferably, fuser assembly 76 includes rollers 78, 80 and 82. The sheet passes between rollers 80 and 82 which apply pressure thereon to permanently affix the toner powder image to the copy sheet. Thereafter, exiting rollers 84 advance the sheet in the direction of arrow 86 onto catch tray 88 for subsequent removal from the printing machine by the operator.

As belt 10 advances, the residual toner particles adhering to the photoconductive surface are passed through the combined developing-cleaning unit 46 which removes the residual toner particles from the photoconductive surface of belt 10. During the second cycle voltage source 56, electrically biases the tubular member 50 to a potential having a magnitude greater than the developing potential of the first cycle. In this way, the toner particles are attracted to the carrier granules adhering to the tubular member 50. Thus the residual toner particles are removed from the photoconductive surface and returned to the combined developing-cleaning unit for subsequent reuse.

After the residual toner particles have been cleaned from the photoconductive surface of belt 10, the residual charge thereon passes beneath combined exposing-discharging unit 36. At the time, a light shutter permits light rays from light source 38 to be transmitted through fiber optic tube 44 onto the photoconductive surface. These light rays illuminate the photoconductive surface to remove any residual electrostatic charge remaining thereon prior to the charging thereof for the next successive cycle. During the first cycle, the shutter prevents light rays from light source 36 from being transmitted through tube 44.

Figure 2:
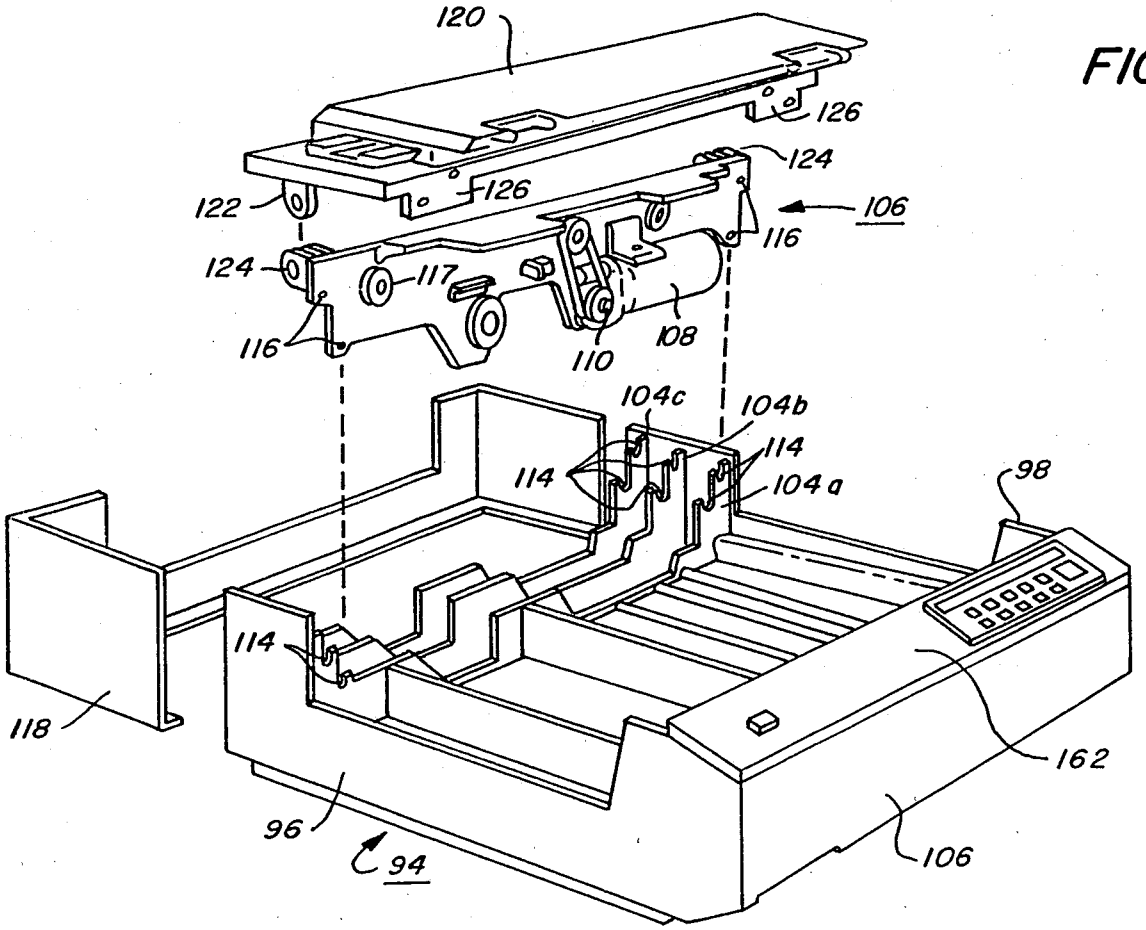
FIG. 2 is an exploded isometric of the lower frame member, rear cover, machine drive module and platen drive showing three alternate mounting elements in the lower frame member for mounting the machine drive to provide three alternate machine process widths.

With continued reference to FIGS. 2 through 4, the frame assembly according to the present invention will be described in greater detail. Lower frame member 94 is generally depicted as including side frame portions 96 and 98 together with front cover 100, a base 101 and a top control panel plate 102. Lower frame member 94 may be of molded plastic having integrally molded therein a plurality of mounting elements 104*a*, 104*b*, and 104*c* spaced from each other and parallel to the front cover 100 thereby providing mounting elements for individual reproducing apparatus components providing different width process paths in the direction of the arrow based on the distance between mounting elements 104*a*, 104*b*, 104*c* to the front cover 100. Also integrally moded within the lower frame member may be suitably positioned braces and supports to provide a rigid structure or additional support to the individual reproducing apparatus components. In the machine, drive module generally indicated by reference numeral 106 may include a variety of components but here is illustrated as including a drive motor 108, a developer drive sprocket 110, a fuser drive coupling 111, and several other similiar coupling elements to be coupled to the individual reproducing apparatus components as they are placed in the machine. The machine drive module 106 may be placed on and mounted to any one of mounting elements 104*a*, 104*b*, 104*c* to provide the desired process width. This mounting is accomplished through securing of holes 116 in the machine drive module with mating slots 114 in the lower frame member 94 by means of suitable fasteners such as screws. The rear machine cover 118 which also may be a plastic molded cover may be directly fastened to the machine drive module 106 or the platen drive module 120 by any suitable fastening means such as by a bolt (not shown) onto the platen drive module 120. As may be observed with reference to FIG. 2, the rear cover 118 is slidably engageable with the lower frame member and can be positioned at a depth to the rear from the front cover 100 dependent upon the location of the machine drive module 106 in any of mounting elements 104*a*, 104*b*, 104*c*. In this way by the mounting of drive module 116 on mounting element 104*a*, for example, the size of the machine may be minimized when its capability is to reproduce only small size documents on small size copy sheets. Alternatively, the size will be larger when it is to be capable of producing from large size originals onto large size copy sheets for example, when the location of the machine drive module 106 is mounted on mounting elements 104*c*.

The lower frame member may be made from any suitable moldable material. Typical thermosetting plastics with structural reinforcements such as glass fibers may for example, be used. A particularly satisfactory group of materials are the thermosetting moldable polyester compounds filled with from about 20 to about 25% of small glass fibers. The integrated molded frame may be manufactured with any suitable molding technique such as compression molding or transferring molding.

The platen drive module 120 referred to herein above may be mounted directly onto the machine drive module 106 through positioning of platen mount slot 122 on platen drive module 120 into the mating platen mount bracket 124 on both sides of the machine drive module 106 and securing it thereto. Additionally, the platen assembly 130 (see FIGS. 4*a*, 4*b*, 4*c*) may be mounted directly to the platen drive module 120 by securing platen drive mounting plates 126 to platen mounting plate 128. The platen assembly includes in addition to platen 24 a platen cover 132 mounted to the platen assembly 130 through means of platen cover hinge 134.

Figure 4A:
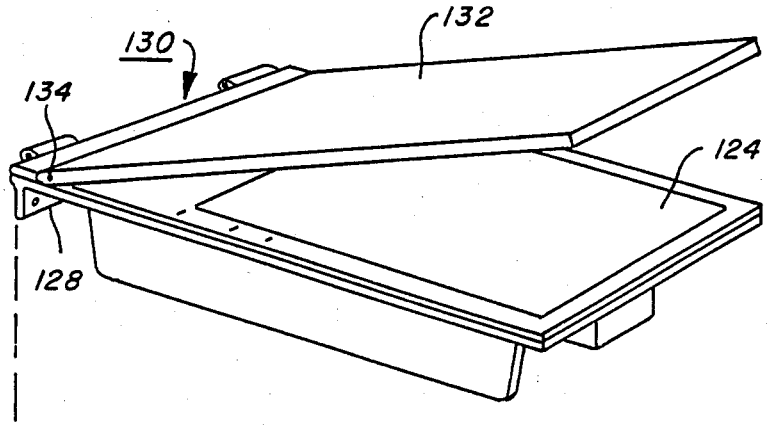
FIGS. 4*a*, 4*b*, and 4*c* are isometric representations of three platen assemblies of three different sizes for use with the reproducing apparatus components of different size like those of FIG. 3 thereby providing reproduction of original documents of different sizes.
Figure 4B:
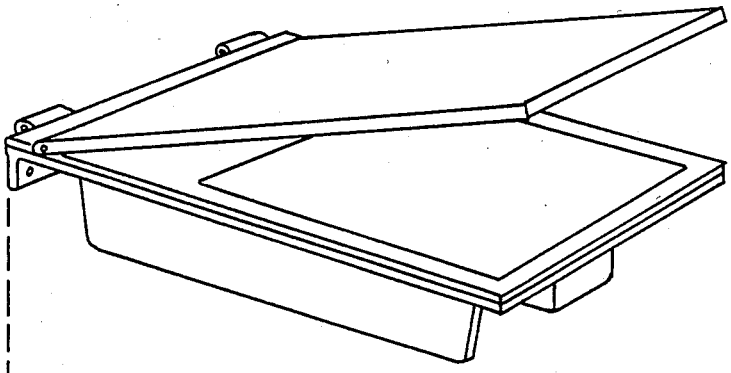
Figure 4C:
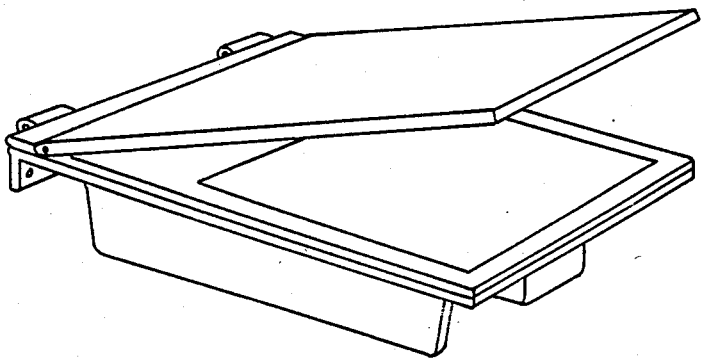

Depending upon the location of the machine drive module 106 in lower frame mounting elements 104*a*, 104*b*, 104*c* together with the mounting of the platen drive module 120 on the machine drive module 106, different size platen assemblies 130 as illustrated in FIGS. 4*a*, 4*b*, and 4*c* corresponding to the process width capability of the machine may be provided.

Figure 3:
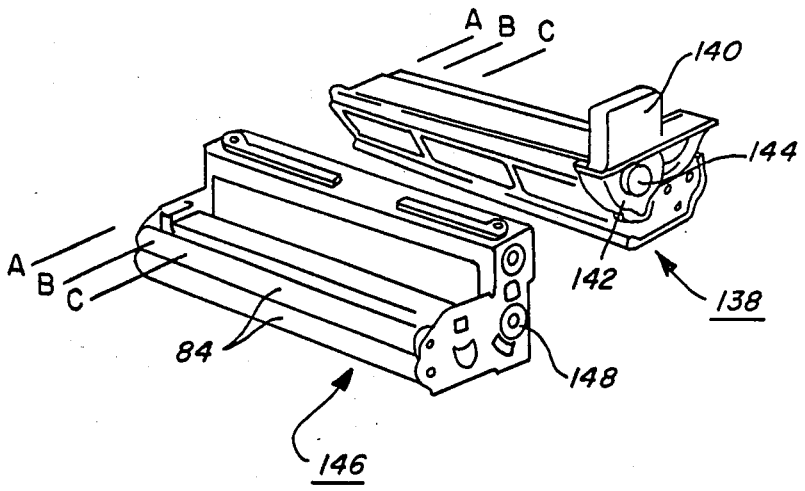
FIG. 3 is an isometric representation of a developer housing and a fuser assembly indicating that each may be common in design differing in three process widths according to A, B and C.

Similarly and with specific reference to FIG. 3 developer housing 138 and toner fuser assembly 146 may be the same for machines having different copying capability and different process widths, differing only from each other in the width in the process direction of the individual assemblies. For illustration purposes only a representative developer housing and fuser assembly are illustrated it being recognized that other individual reproducing apparatus components can be suitably modified in the direction of the process width to be used with the frame assembly according to the present invention. The developer housing 138 includes a toner supply bottle 140 from which a supply of toner falls into toner dispenser 142 which dispenses the toner to the cylindrical magnetic developer-cleaning roller. The developer housing may be mounted to the front cover frame 100 of the lower frame member 94 through mounting pin 144 at one end and also suitably mounted and driven by a sprocket (not shown) into the developer drive sprocket 110 on the machine drive module. Similarly the fuser assembly generally depicted as 146 includes rolls 78, 80, 82 and output delivery rolls 84 which may be mounted in similar fashion to the front cover 100 through pin 48 and to the machine drive module through a fuser drive sprocket 111 on machine drive module 106.

While the figures illustrate a plurality of three different placements 104*a*,104*b*, 104*c* of the machine drive module 106, thereby providing three different process widths it should be noted that any number of mounting elements for a different process widths may be supplied. Listed below are common sheet sizes of documents which are likely to be reproduced and therefore require the indicated process width in order to produce a faithful reproduction.

COMMON STANDARD COMMERCIAL PAPER SHEET SIZES

| Size Description | Size in Inches | Sizes in Centimeters |
|---|---|---|
| 1. U.S. Government (old) | 8 × 10.5 | 20.3 × 26.7 |
| 2. U.S. Letter | 8.5 × 11 | 21.6 × 27.9 |
| 3. U.S. Legal | 8.5 × 13 | 21.6 × 33.0 |
| 4. U.S. Legal | 8.5 × 14 | 21.6 × 35.6 |
| 5. U.S. Engineering | 9 × 12 | 22.9 × 30.5 |
| 6. ISO* B5 | 6.93 × 9.84 | 17.6 × 25.0 |
| 7. ISO* A4 | 8.27 × 11.69 | 21.0 × 29.7 |
| 8. ISO* A3 | 11.69 × 16.54 | |
| 9. ISO* B4 | 9.84 × 13.9 | 25.0 × 35.3 |
| 10. Japanese B5 | 7.17 × 10.12 | 18.2 × 25.7 |
| 11. Japanese B4 | 10.12 × 14.33 | 25.7 × 36.4 |

As may be observed from the foregoing description and drawings a family of alternative copiers may be produced according to the practice of the present invention. They may be shallower from the front to the rear corresponding to the various process widths desired. This is accomplished with the placement of the machine drive module on the appropriate mounting element in the lower frame as well as providing a bootlike rear cover which is slidably engageable with the lower frame members and may be fixed either to the drive module or to the platen drive assembly. This provides a single machine frame for use in the manufacture of the family of copiers having different production capabilities in terms of process widths. It should be noted that the family of copiers so produced have common lower frame members, front and side covers, rear covers, as well as a common machine drive module and a platen drive module. The remaining process components such as developer, photoreceptor, and fuser need be modified only in the process width direction. With the variable dimension frame assembly according to the present invention, the front and rear covers can be mounted in telescopic fashion. With the dramatic increase in common parts a plurality of machines having different copying capabilities in the process direction may be achieved with a dramatic reduction in the design, development and manufacture costs of the machines. Furthermore the present invention provides the manufacturer with the ability to assemble simultaneously or closely consecutively in time a large number of machines having different reproducing capabilities. It also enables the manufacturer to be able to switch from the manufacture of a machine having one capability to a machine having another capability in a relatively short period of time. Furthermore it will also enable the manufacturer as well as the service organization to maintain a reduced inventory of spare parts for a family of products since there is very high commonality of parts over a whole family of products. In addition to the high commonality of parts, the present invention permits the design and use of other components for different machines modified only with respect to process width. This enables a common design approach as well as commonality for all end plates and mounts.

The disclosures of the patents referred to herein are hereby specifically and totally incorporated herein by reference.

While the invention has been described with reference to specific embodiments thereof it will be apparent to those skilled in the art that many alternatives, modifications and variations may be made. For example, while the invention has been illustrated with regard to a magnetic brush development apparatus, it should be understood that virtually any type of development mechanism may be used. While the invention has been specifically illustrated with reference to three positions for the mounting elements to be attached to the lower frame member it should be understood that any number of such mounting elements may be used depending on the desires of the designer and manufacturer. Furthermore, while the invention has been illustrated with reference to an integrally molded lower frame member it will be understood that such frame member may be fabricated in other ways. While the invention has been illustrated for use with a copier it will be understood that it could be equally applicable to use in a printer application. Accordingly it is intended to embrace all such alternatives and modifications as may fall within the spirit and scope of the appended claims.

What is claimed is:

1. An automatic reproducing apparatus comprising a frame assembly for mounting thereto individual reproducing apparatus components, said frame assembly including a lower frame member having a plurality of alternate mounting elements attached thereto for mounting at least one reproducing apparatus component thereto, said mounting elements being spaced from each other and arranged in parallel fashion in one direction from one side of the frame member to the opposite side of the frame member whereby components may be mounted to said lower frame member at one of said alternate mounting elements of the plurality of mounting elements to provide the assembly of automatic reproducing machines having one of a plurality of process widths corresponding to the distance from said one side of the frame member to said one of said alternate mounting elements.

2. The apparatus of claim 1, wherein said lower frame member is a plastic molded frame and said plurality of mounting elements are integrally molded therein.

3. The apparatus of claim 1, wherein each of said plurality of mounting elements is the same differing from each other only in the distance it is spaced from said one side of said frame member.

4. The apparatus of claim 1, wherein the plurality of mounting elements are each spaced from said one side of said frame member a distance to provide a process width corresponding to a standard commercial paper size.

5. The apparatus of claim 1, wherein said one side of said frame member corresponds to the front of an automatic reproducing apparatus and said mounting element are spaced therefrom toward the rear of the automatic reproducing apparatus.

6. The apparatus of claim 4, wherein said plurality of mounting elements are mounting elements for a reproducing apparatus drive module.

7. The apparatus of claim 2, wherein said lower frame member includes integrally molded front and side covers for said reproducing apparatus.

8. The apparatus of claim 1, further including a rear frame member comprising a cover and means to fasten said rear cover to said lower frame member at alternate different positions corresponding to one of said plurality of alternate mounting elements to provide an apparatus of the process width corresponding to said one of said plurality of mounting elements.

9. The apparatus of claim 6, further including said drive module and wherein the front of said frame member includes means to mount one end of at least one reproducing apparatus component thereto and said drive module includes means to mount the other end of said at least one component thereto.

10. The apparatus of claim 9, wherein said drive module includes means to mount a platen drive thereto.

11. The apparatus of claim 9, wherein said at least one reproducing apparatus component comprises a developer housing.

12. The apparatus of claim 9, wherein said at least one reproducing apparatus component comprises a fuser assembly.

* * * * *